US006253042B1

(12) United States Patent
Yang

(10) Patent No.: US 6,253,042 B1
(45) Date of Patent: Jun. 26, 2001

(54) METHOD FOR CONTROLLING A FAN OF AN ELECTRONIC PHOTO DEVICE

(75) Inventor: Cheol-Ju Yang, Daegu (KR)

(73) Assignee: SamSung Electronics Co., Ltd., Kyungki-do (KR)

( * ) Notice: Subject to any disclaimer, the term of this patent is extended or adjusted under 35 U.S.C. 154(b) by 0 days.

(21) Appl. No.: 09/466,801

(22) Filed: Dec. 20, 1999

(30) Foreign Application Priority Data

Dec. 19, 1998 (KR) ..... 98/56407

(51) Int. Cl.[7] ..... G03G 21/20

(52) U.S. Cl. ..... 399/92; 355/30; 399/45; 399/94

(58) Field of Search ..... 399/92, 91, 94, 399/98, 309, 320, 44, 45; 355/30; 219/216

(56) References Cited

U.S. PATENT DOCUMENTS 5,218,411 * 6/1993 Kosugiyama et al. ..... 399/341
5,379,999 1/1995 Barzideh et al. ..... 271/264
5,457,516 10/1995 Kim ..... 399/37
5,666,187 9/1997 Kim ..... 399/92 X
5,930,572 * 7/1999 Haneda et al. ..... 399/309
5,956,554 9/1999 Yanashima et al. ..... 399/328

* cited by examiner

*Primary Examiner*—Sophia S. Chen
*Assistant Examiner*—Hoan Tran
(74) *Attorney, Agent, or Firm*—Robert E. Bushnell, Esq.

(57) ABSTRACT

Disclosed is a method for controlling the operation of a fan in an electronic photo device including a developing device, a fan for keeping the temperature in the electronic photo device uniformly, and an output sensor for sensing output of a printed paper. According to the method, when a printable medium to be printed with print data is located between a transferring roller and an OPC drum of the developing device, the sort of the printable medium is determined. If it is determined that the printable medium is a first printable medium, the fan is stopped and a fixing process is performed. Otherwise, if it is determined that the printable medium is a second printable medium, the fixing step is performed under the condition that the fan is not stopped.

16 Claims, 2 Drawing Sheets

METHOD FOR CONTROLLING A FAN OF AN ELECTRONIC PHOTO DEVICE

CLAIM OF PRIORITY

This application makes reference to, incorporates the same herein, and claims all benefits accruing under 35 U.S.C. §119 from my application *METHOD FOR CONTROLLING A FAN OF AN ELECTRONIC PHOTO DEVICE* filed with the Korean Industrial Property Office on Dec. 19, 1998 and there duly assigned Ser. No. 56407/1998.

BACKGROUND OF THE INVENTION

1. Field of the Invention

This invention relates to a method for controlling a fan of an electronic photo device. More specifically, the present invention relates to a method for controlling the operation of the fan in the electronic photo device to keep the temperature in the device as a suitable level to the characteristics of print papers and thereby provide an enhanced print quality.

2. Description of the Related Art

Generally, an electronic photo device such as a copying machine and a printer includes a pickup roller, a charging roller, an organic photoconductive (OPC) drum, a transferring roller, a developing roller, a supplying roller, a fixing unit and an exposing device, a cleaning blade, a fan for keeping the temperature in the electronic photo device from increasing, an output sensor for sensing the output of a printed paper, and a printer controller for controlling the above-described components and performing data printing operation. By means of the components, the electronic photo device prints a predetermined image data on a print paper.

The charging roller, the developing roller, the transferring roller and the supplying roller are provided with a charging voltage of −1.4 kV, a developing voltage of −300 V, a transferring voltage of +2.0 kV, and a supplying voltage of −500 V, respectively.

Now, the printing process by the electronic photo device will be described hereinafter. First, the charging roller is charged by the charging voltage with a high pressure and rotated to evenly charge a photosensitive body formed on the outer periphery of the OPC drum. At this time, a light emitted from the exposing device forms an electrostatic latent image on the outer periphery of the charged OPC drum. Then, a potential difference occurs between the supplying roller supplied with a high pressure supplying voltage and the developing roller supplied with a lower voltage than the supplying roller.

Accordingly, negative charges move from the supplying roller to the developing roller. In this manner, toner is moved from the supplying roller to the developing roller. The toner is then coated on the electrostatic latent image formed on the outer periphery of the OPC drum so that the electrostatic latent image is changed into a visible image. The transferring roller with a high pressure transfers the visible image formed on the OPC drum with the toner to a transferred paper. The transferred visible image is fixed to the paper by heat and pressure of the fixing unit. In this manner, the printing process is completed.

On the other hand, the electronic photo device adopts at least a single fan to cool the heat used in fixing the toner to the print paper and keep the fixing temperature as a lower level than a predetermined temperature.

However, the electronic photo device including the fan suffers from several problems.

In the event that a great heat is initially supplied to the print paper with much toner coated thereon, there is a phenomenon that the paper is ironed by the heat and, resultantly, the paper may be wrinkled.

Moreover, in the case of an overhead projector (OHP) film, humidity and dyestuff of the overhead projector film is vaporized by the great heat. As a result, the fixed state of the toner is deteriorated and the printed image may be transformed.

Examples from the conventional art involving operation of electrophotographic devices are seen in the following U.S. Patents.

U.S. Pat. No. 5,379,999, to Barzideh et al, entitled Sheet Media Handling Apparatus, describes an electrophotographic device in which the sheet media is controlled by air from a fan.

U.S. Pat. No. 5,457,516, to Kim, entitled Energy Saving Image-Forming Apparatus And Control Method Therefor, describes a printer apparatus including a ventilation fan for cooling the internal portions of the printer. The method includes turning off the power to the fan when the apparatus fails to receive an input within a predetermined time period.

U.S. Pat. No. 5,666,187, to Kim, entitled Method And Apparatus For Controlling The Driving Of An Ozone Emission Fan In An Image Forming Apparatus, describes driving the ozone emission fan when an external printing command is received and stopping the ozone emission fan after the printing operation.

U.S. Pat. No. 5,956,554, to Yanashima et al, entitled Sheet Driving Prevention Device, describes a printer with fans in the vicinity of the fixing device to blow air onto a continuous form when printing is stopped, to prevent heating of the continuous form.

Based on my reading of the art, then, I have decided that what is needed is an improved method for operating an electrophotographic device which prevents damage to the image on an overhead projector film.

SUMMARY OF THE INVENTION

It is therefore an object of the present invention to provide an improved method for operating an electrophotographic device.

It is a further object of the present invention to provide a method which prevents wrinkling of printing paper with a high level of toner.

Another object of the invention is to provide a method which prevents deterioration of the toner image on overhead projector film.

Yet another object of the present invention to reduce the noise of the cooling fan in the electrophotographic device.

To achieve the objects and other objects, the present invention provides a method for controlling the operation of the fan of the electronic photo device including a developing device, a fan for keeping the temperature in the electronic photo device uniformly, and an output sensor for sensing the output of a printed paper. According to the method, when a printable medium to be printed with print data is located between a transferring roller and an organic photoconductive drum of the developing device, it is determined what sort of printable medium the printable medium is. If it is determined that the printable medium is a first sort of printable medium, the fan is stopped and a fixing process is performed. Otherwise, if it is determined that the printable medium is a second sort of printable medium, the fixing step is performed under the condition that the fan is not stopped.

As an embodiment of the present invention, the first and the second sorts of printable mediums may be overhead projector film and general paper, respectively. Moreover, the sort ofthe printable medium may be determined by the resistance value of the printable medium.

Preferably, the method of the present invention further includes the steps of: determining whether the upper end, that is, the leading edge, of the fixed printable medium is passed by the output sensor or not; and if it is determined that the upper end of the fixed printable medium is passed by the output sensor, in the case that the fixed printable medium is the first sort of printable medium, stopping the fan and operating the fan again when the bottom end of the first sort of printable medium is passed by the output sensor, and, in the case that the fixed printable medium is the second sort of printable medium, operating the fan after the second sort of printable medium passes by a predetermined point, for example, 25 mm from the output sensor.

Preferably, the method of the present invention further includes the step of operating the fan by a predetermined rotating speed, for example, 60~70% of a normal rotating speed, for a predetermined time, for example, 30 seconds, after a printing process is completed.

BRIEF DESCRIPTION OF THE DRAWINGS

A more complete appreciation of the invention, and may ofthe attendant advantages, thereof, will be readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENTS

Figure 1:
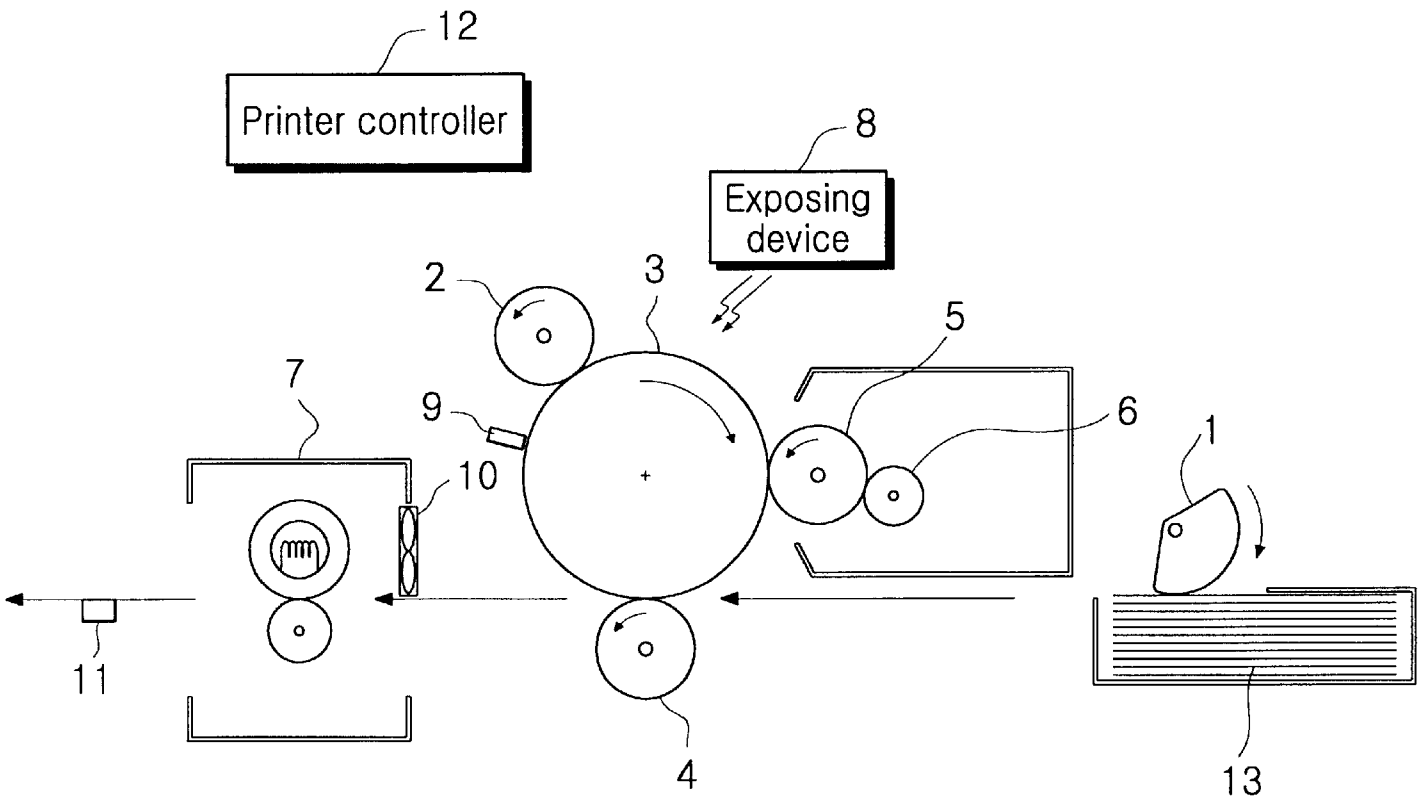
FIG. 1 is a schematic diagram of an electronic photo device.

The general electronic photo device described above will now be described with reference to the drawings. Generally, an electronic photo device such as a copying machine and a printer includes, as shown in FIG. 1, a pickup roller 1, a charging roller 2, an organic photoconductive (OPC) drum 3, a transferring roller 4, a developing roller 5, a supplying roller 6, a fixing unit 7 and an exposing device 8, a cleaning blade 9, a fan 10 for keeping the temperature in the electronic photo device from increasing, an output sensor 11 for sensing the output of a printed paper, and a printer controller 12 for controlling the above-described components and performing data printing operation. By means of the components, the electronic photo device prints a predetermined image data on a print paper.

The charging roller 2, the developing roller 5, the transferring roller 4 and the supplying roller 6 are provided with a charging voltage of −1.4 kV, a developing voltage of −300 V, a transferring voltage of +2.0 kV, and a supplying voltage of −500 V, respectively.

Now, the printing process by the electronic photo device will be described hereinafter. First, the charging roller 2 is charged by the charging voltage with a high pressure and rotated to evenly charge a photosensitive body formed on the outer periphery of the organic photoconductive drum At this time, a light emitted from the exposing device 8 forms an electrostatic latent image on the outer periphery of the charged organic photoconductive drum 3. Then, a potential difference occurs between the supplying roller 6 supplied with a high pressure supplying voltage and the developing roller 5 supplied with a lower voltage than the supplying roller 6.

Accordingly, negative charges move from the supplying roller 6 to the developing roller 5. In this manner, toner is moved from the supplying roller 6 to the developing roller 5. The toner is then coated on the electrostatic latent image formed on the outer periphery of the organic photoconductive drum 3 so that the electrostatic latent image is changed into a visible image. The transferring roller 4 with a high pressure transfers the visible image formed on the organic photoconductive drum 3 with the toner to a transferred paper 13. The transferred visible image is fixed to the paper 13 by heat and pressure of the fixing unit 7. In this manner, the printing process is completed.

On the other hand, the electronic photo device adopts at least a single fan 10 to cool the heat used in fixing the toner to the print paper 13 and keep the fixing temperature at a lower level than a predetermined temperature.

Now, the present invention will now be described more fully hereinafter with reference to the accompanying drawings. Terminologies used hereinafter are defined in consideration of the functions in the present invention and may be changed according to intends of those skilled in the art or convention. Therefore, the definitions of the terminologies should be made based on the entire contents of the specification of the present invention.

The method for varying the operation of a fan of an electronic photo device according to the characteristics of a print paper according to the present invention is programed and performed by a printer controller. The structure of the electronic photo device for performing the present invention may be generally the same with that shown in FIG. 1. Accordingly, the description thereof will be omitted.

The fan control method according to the present invention is largely divided into two parts: one is control while a printing process is performed; and the other is control right after a printing process is completed. The control while a printing process is performed is further divided into two: one is control when a general print paper is printed; and the other is control when an overhead projector (OHP) film is printed.

First, in the case that the general print paper is printed, the fan is stopped when the paper is passed by the transferring roller, and rotated again when the paper is passed by a predetermined point, for example, 25 mm point from the output sensor. In the case that the overhead projector film is printed, the fan is stopped when the overhead projector film is passed by the output sensor and rotated again when the bottom end, that is, the trailing edge, of the overhead projector film is passed by the output sensor.

On the other hand, right after a printing process is completed, the fan is rotated for a predetermined time, for example about 30 seconds, in order to lower the temperature in the electronic photo device. At this time, the rotating speed of the fan is controlled to 60~70% of a normal rotating speed, whereby noise can be reduced.

Figure 2:
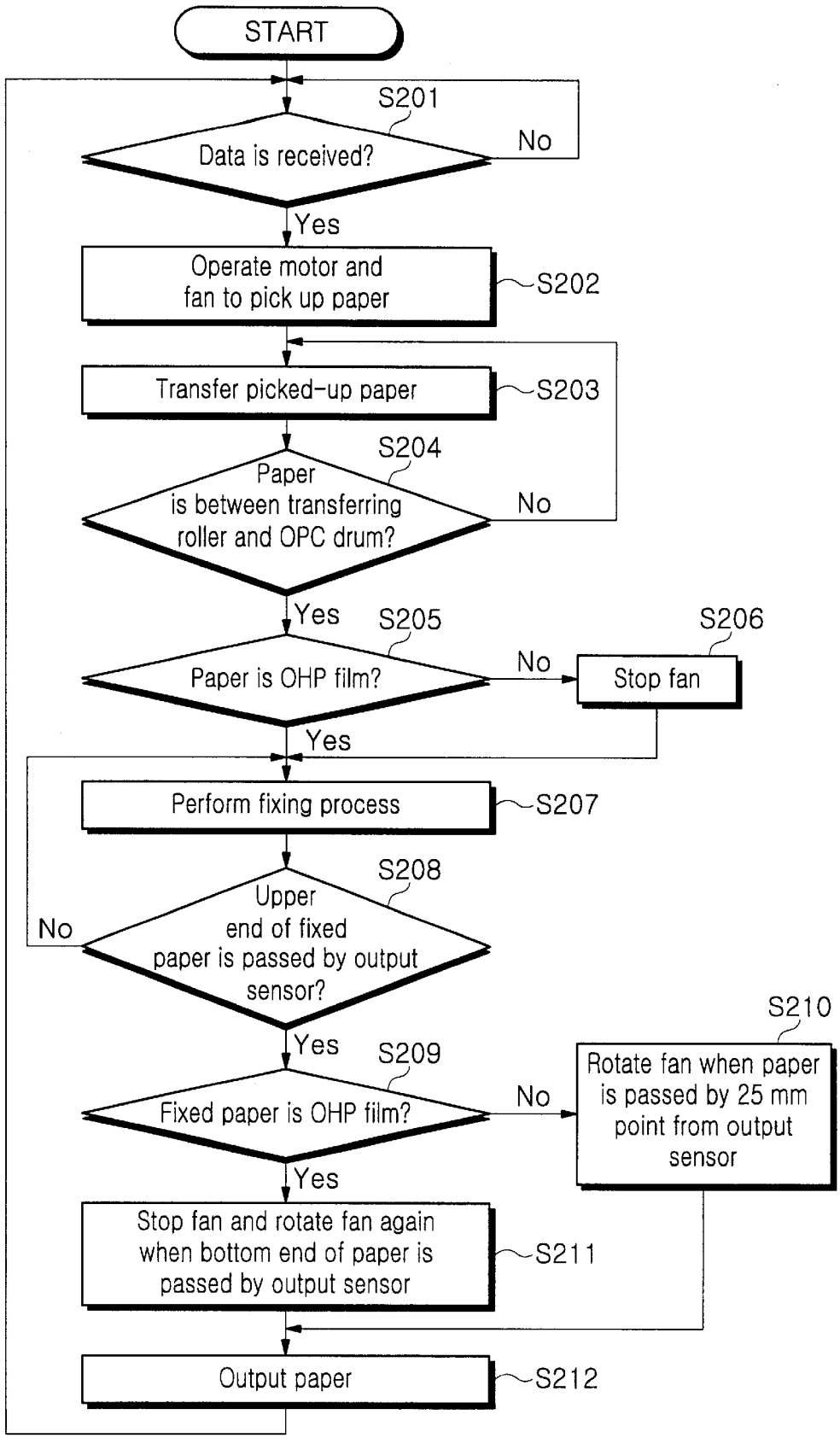
FIG. 2 is a flowchart of a method for controlling the operation of a fan of an electronic photo device according to the characteristics of a print paper according to the present invention.

The method for differently controlling the operation of the fan of the electronic photo device according to the characteristics of the print paper according to the present invention will be described with reference to FIG. 2.

First, it is determined whether print data is received from a host computer or not, that is, whether a print order is received (S201).

If it is determined that print data is received from the host computer, a motor and the fan are operated and a print paper is picked up (S202).

The picked-up paper is then transferred to the space between the transferring roller and the organic photoconductive drum (S203 and S204).

After the picked-up paper is transferred to the space between the transferring roller and the organic photoconductive drum, it is determined whether the transferred paper is an overhead projector film or not (S205). At this time, as an embodiment, the determination as to whether the transferred paper is an overhead projector film or not is made by reading the resistance value of the paper.

If it is determined that the transferred paper is not the overhead projector film, in other words if the transferred paper is a general paper, the rotation of the fan is stopped and a fixing process is performed (S206 and S207). If it is determined that the transferred paper is an overhead projector film, the fan is continuously rotated and the fixing process is simultaneously performed (S207).

Thereafter, it is determined whether the upper end of the toner-fixed paper is passed by the output sensor or not (S208). If it is determined that the upper end, that is, the leading edge, of the toner-fixed paper is passed by the output sensor, it is determined whether the toner-fixed paper is the overhead projector film or not (S209).

If it is determined that the toner-fixed paper is not an overhead projector film, in other words, if the toner-fixed paper is a general paper, when the paper is passed by a predetermined point from the output sensor, the fan is rotated (S210). Otherwise, if it is determined that the toner-fixed paper is an overhead projector film, the rotation of the fan is stopped and the fan is rotated again when the bottom end, that is, the trailing edge, of the paper is passed by the output sensor (S211).

Thereafter, the paper is output (S212). In this manner, a data printing process with a single paper is completed.

On the other hand, right after the printing process is completed, the fan is rotated for a predetermined time, for example, about 30 seconds, in order to lower the temperature in the electronic photo device. At this time, the rotating speed of the fan is controlled to 60~70% of the normal rotating speed so that noise caused by the rotation of the fan can be reduced. The above-described process is repeatedly performed for every page to be printed.

As described above, the present invention is capable of providing high quality print by varying the operation of the fan in an electronic photo device according to the characteristics of a print paper when the paper is passed by the space where the fan is installed. Even right after a printing process is completed, the noise that may be caused by rotation of the fan for cooling the interior of the electronic photo device can be reduced to a minimum by differently controlling the operation of the fan.

This invention has been described above with reference to the aforementioned embodiments. It is evident, however, that may alternatives, modifications and variations will be apparent to those having skill in the art in light of the foregoing description. Accordingly, the present invention embraces all such alternatives, modifications and variations as fall within the spirit and scope of the appended claims and their equivalents.

What is claimed is:

1. A method for controlling operation of a fan in an electronic photo device, comprising the steps of:

when a printable medium to be printed with print data is located between a transferring roller and an organic photo conductive (OPC) drum of a developing device of the electronic photo device, determining what sort of printable medium is the printable medium;

when said printable medium is a first sort of printable medium, stopping the operation of a fan for keeping the temperature uniform in the electronic photo device and performing a fixing process; and when said printable medium is a second sort of printable medium, performing said fixing process under the condition that said fan is not stopped.

2. The method of claim 1, wherein said second sort of printable medium includes overhead projector film.

3. The method of claim 1, wherein said first sort of printable medium includes general paper.

4. The method of claim 1, wherein said sort of said printable medium is determined by measuring a resistance value of said printable medium.

5. The method of claim 1, further comprising the steps of: determining whether an upper end ofthe fixed printable medium is passed by an output sensor;

when said upper end of the fixed printable medium is passed by said output sensor, and when the fixed printable medium is said first sort of printable medium, stopping said fan and operating said fan when a bottom end of said first printable medium is passed by said output sensor, and when the fixed printable medium is said second sort of printable medium, operating said fan after said second printable medium is passed by a predetermined point from said output sensor; and terminating a printing process.

6. The method of claim 5, wherein said predetermined point is 25 mm from said output sensor.

7. The method of claim 5 further comprising the step of, after said printing process is terminated, operating said fan at a predetermined rotating speed for a predetermined time.

8. The method of claim 7, wherein said predetermined time is 30 seconds.

9. The method of claim 7, wherein said predetermined rotating speed is 60 to 70% of a normal rotating speed of said fan.

10. A method for operating an electrophotographic device, comprising the steps of:

when a print order is received, then operating a fan for cooling a fixing unit of the electrophotographic device, and picking up a paper for printing;

transferring the picked up paper to the space between a transferring roller and an organic photoconductive drum of the electrophotographic device;

determining whether the transferred paper is an overhead projector film;

when the transferred paper is not an overhead projector film, then stopping said fan and fixing the transferred paper in the fixing unit; and when the transferred paper is an overhead projector film, then continuing to operate the fan and fixing the transferred paper in the fixing unit.

11. The method of claim 10, further comprising:

when the leading edge of a fixed paper which is not an overhead projector film passes a predetermined point at a predetermined distance from an output sensor, then operating said fan; and when the leading edge of a fixed paper which is an overhead projector film passes said output sensor, then stopping the fan, and when the trailing edge of the fixed paper passes said output sensor, then restarting the fan.

12. The method of claim 11, the predetermined distance being approximately 25 mm.

13. The method of claim 11, further comprising the step of:

after the fixed paper is output from the electrophotographic device, then operating the fan for a predetermined period and then stopping the fan.

14. The method of claim 13, said step of operating the fan for a predetermined time comprising operating the fan for approximately 30 seconds.

15. The method of claim 13, said step of operating the fan for a predetermined time comprising operating the fan at a speed in the range of approximately 60 to 70% of a normal rotation speed.

16. The method of claim 10, said step of determining whether the paper is an overhead projector film comprising measuring the resistance value of the paper.

* * * * *